United States Patent [19]

Inohara et al.

[11] 4,063,408

[45] Dec. 20, 1977

[54] DIRECT DOUBLE TWIST CABLER

[75] Inventors: Shu Inohara; Yasuyuki Nagamune, both of Osakashi; Bunjiro Tanigaki, Sakaishi, all of Japan

[73] Assignee: Kabushiki Kaisha Kajitekkosho, Osaka, Japan

[21] Appl. No.: 701,239

[22] Filed: June 30, 1976

[51] Int. Cl.[2] ..... D01H 1/10; D01H 7/86

[52] U.S. Cl. ..... 57/58.54

[58] Field of Search ..... 57/34 R, 58.49, 58.52, 57/58.54, 58.55, 58.65, 58.81, 58.68, 80, 106

[56] References Cited

U.S. PATENT DOCUMENTS

| | | | |
|---|---|---|---|
| 2,487,837 | 11/1949 | Uhlig | 57/58.55 |
| 2,586,123 | 2/1952 | Truitt | 57/58.55 |
| 2,635,413 | 4/1953 | Truitt | 57/58.52 |
| 2,654,210 | 10/1953 | Bogdanffy et al. | 57/58.55 |
| 3,172,247 | 3/1965 | Chapuis et al. | 57/58.55 X |
| 3,296,787 | 1/1967 | Maurin | 57/58.81 |
| 3,846,965 | 11/1974 | Matsumara et al. | 57/58.54 X |
| 3,942,312 | 3/1976 | Venot | 57/106 X |
| 3,969,884 | 7/1976 | Inohara et al. | 57/58.54 |

*Primary Examiner*—Donald Watkins

*Attorney, Agent, or Firm*—Eyre, Mann, Lucas & Just

[57] ABSTRACT

The invention provides an improved direct double twist cabler including two-for-one spindles for cabling as well as for plying, wherein the plying spindles are horizontally supported above the cabling spindle, and wherein the cabling spindle is supported slantly in the range of 5° to 15° outwardly, so as to lengthen the path of yarn before entering the cabling spindle without the possibility of obstructing a handling operation, and a yarn breakage detecting-and-stopping means interposed between the plying spindles and the cabling spindle.

10 Claims, 11 Drawing Figures

DIRECT DOUBLE TWIST CABLER

The present invention relates to a direct double twist cabler adapted for the manufacture of cordage particularly for industrial uses, such as belting, tyres, fishing nets, ropes, wherein the cordage structure consists of plying and cabling. More particularly, the present invention relates to a direct double twist cabler on which the lying and the cabling are completed continuously without any intermediate operation therebetween, such as doffing, thereby ensuring the production of cordage on a sequential process.

So far many proposals have been made for a continous production of cordage, wherein there are two different processes. One is an equipment having two-for-one spindles for plying in the upper section and ring twisters for cabling in the lower section thereof, which is known by British Pat. No. 896,493; U.S. Pat. Nos. 3,846,965 and 3,918,245, and the other is an equipment having two-for-one spindles both for plying and cabling, which is known by British Pat. No. 915,942; U.S. Pat. Nos. 2,487,838 and 2,654,210. Therefore the concept of a continuous cordage production is no longer new, but the expedients referred to above are not perfectly successful and have their own difficulties.

With the first-mentioned equipment one of the difficulties is derived from the use of a ring twister, which detrimentally affects the cabling performance. By using a ring twister the advantage of using a two-for-one spindle is counter-balanced; for example, one of the problems comes from the difference in tension between the two-for-one spindle and the ring twister. This is harmful to the structure of cordage. A further problem is an unequal operational speed between plying and cabling, thereby resulting in the reduced efficiency. This is caused by the limitation of speed on the part of the ring twister.

With the second-mentioned equipment employing two-for-one spindles both for plying and cabling, it can be pointed out as its major advantage that various advantages proper to the employment of two-for-one spindles are obtainable. For example, it is not required that such a large take-up bobbin should be rotated at a relatively high speed, as under the ring-twister system, because the twist is imparted to the yarn by a rotating disc, and additionally the double twist is given each rotation thereof, thereby resulting in the increased efficiency and the reduced power consumption. Because of the parallel employment of two-for-one spindles for plying and cabling, both operations can be readily associated, thereby raising the operational speed to the maximum without any problem. As for a take-up bobbin no special type is needed, only if it is adapted for rotaion at a speed sufficient to wind up the yarns fed by the feed rollers, wherein the speed can be slower than that required for the ring-twister system. This eliminates the necessity for the precise fabrication of a take-up bobbin, thereby ensuring a reduced production cost and carefree maintenance of the bobbin. It is needless to say that no take-up bobbin is required for accommodating ply yarns because of the direct passage thereof to the cabling section. Unlike the ring-twister system there is no necessity for a traveller, a lubricant, and the like, and no problem of vibration and noise is caused.

Fundamentally the present invention adopts a continuous system employing two-for-one spindles both for plying and cabling, with the difference from the known equipments disclosed in U.S. Pat. Nos. 2,487,838 and 2,654,210, and British Pat. No. 915,942, the details of which will be explained below:

The first-named two U.S. Patents relate to substantially the same invention, which includes two plying spindles and a cabling spindle uprightly arranged on the same plane as a unit, all the spindles being driven by one electric motor. The capstan above the cabling spindle is rotated by means of a worm gearing provided under the hollow spindle of the cabler. Under this system two first-twisted yarns are met and doubled on the capstan roller, during which it is difficult to equalize the tension between the two yarns. The unequal tension of the yarns is detrimental to the cordage structure. In addition, in this cabling process the yarns are supplied from above and led through the disc eye after ballooning. However, it is known that ballooning tends to become unstable. Besides, magnetism is utilized to drive the bobbin so as to compensate for a reduction of the rotating speed of bobbin as the diameter thereof increases. But, because of the difficulty in adjusting the gap the wind-up tension gradually becomes small as the diameter of the bobbin increases with wound yarns, wherein it is essential to maintain a larger tension than the ballooning tension. The ratio of the two tensions corresponds to that of the empty diameter to the fully-wound diameter, but the initial tension tends to be larger than the practical value. The difficulty in securing an equal or even tension in winding as well as in double twisting badly affects the quality of cordage structure.

The invention disclosed in British Pat. No. 915,942 comprises a group of three plying spindles and a single cabling spindle arranged in a plane, which are driven by means of one electric motor, wherein the supply package is fixed in such a manner as to lightly rotate through bearings. The rotation of the supply package is effected when the yarn is drawn by the capstan roller in the cabler, but when the speed of drawing the yarn is constant the package is subject to changes in angular speed in the center and at opposite ends, thereby causing an overrun trouble and a drop in speed. In order to solve this problem a brake belt is provided in the rim of the package, and a feeler arm is provided so as to keep contact with the yarn, through which the tension is sensed to control the braking. Neverthless uneven tension tends to occur, especially in the initial tension, which, as described above, detrimentally affects the formation of cordage structure.

In addition, in unwinding the yarn from the supply package the yarn is led under the guidance of the parallel bar, which requires the yarns to be kept in touch with the surface of the bar. However, since the supply package is a long cylindrical structure the yarn is placed on the bobbin in its reciprocal movement, which tends to cause a fuzz trouble and a breakage of yarn.

A further problem is seen in the cabling assembly, in which friction members are employed in driving the bobbins, instead of utilizing magnetism as previously referred to. However, compared with the magnetic method the problem is that it is difficult to secure a constant coefficient of friction and an equilibrium among the number of bobbins, thereby resulting in an unstable winding of yarn. The unstable winding indicates an uneven tension in winding, which particularly affects the quality of tyre cord unfavourably. In the production of tyres the material filament is required to have a relatively large extensibility, but under the unstable winding tension the numbers of twists are badly affected, which results in the reduced strength of the cord and also in the difficulty in warping yarns in the subsequent weaving process. All these factors cause a poor quality of tyres.

The present invention aims at solving the problems pointed out above, and has for its object to provide an improved direct double twist cabler in which the twisting and the winding are performed under an ideal condition of tension.

According to the present invention, plying two-for-one spindles are horizontally arranged on a mounting frame, and a cabling two-for-one spindle is arranged slantwise at 5° to 15° with respect to the mounting frame, the first-named spindles being located above the second-named spindle so as to shorten the travelling path of yarns therebetween, thereby eliminating a possible variation in the tension of yarns.

According to another aspect of the present invention a take-up bobbin is detachably mounted in an eccentric position in the cabling spindle with a weight adjacent thereto, so as to position face to face with an operator.

According to a further aspect of the present invention there is a stop motion interposed between the plying spindles and the cabling spindle so as to detect a possible breakage of the yarns and stop the plying operation, thereby ensuring a troublefree continuous process of manufacturing cordage.

The invention will be more particularly described by way of example with reference to the accompanying drawings, in which.

Figure 1:
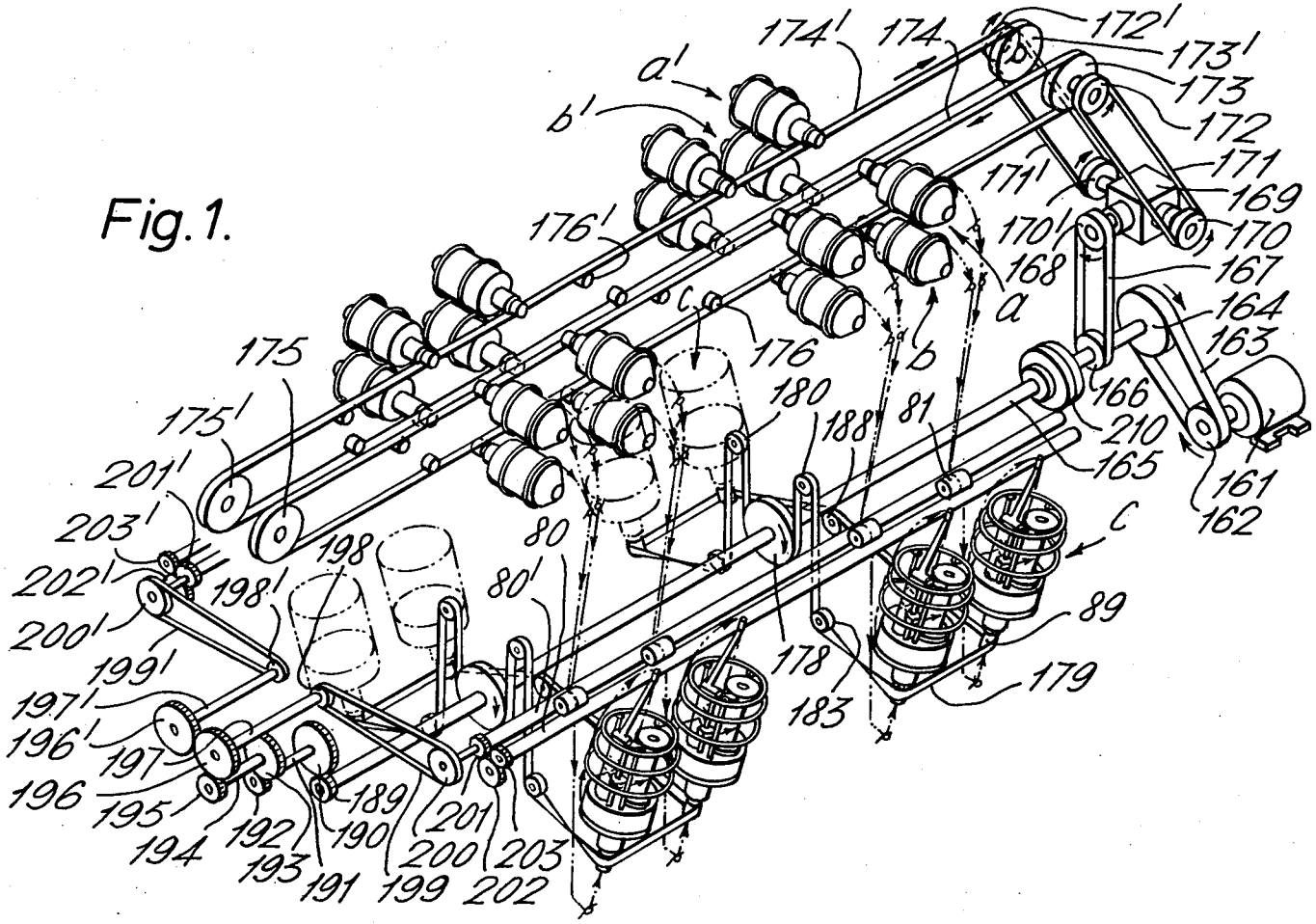
FIG. 1 is a partial perspective view of a direct double twist cabler embodying the present invention.
Figure 2:
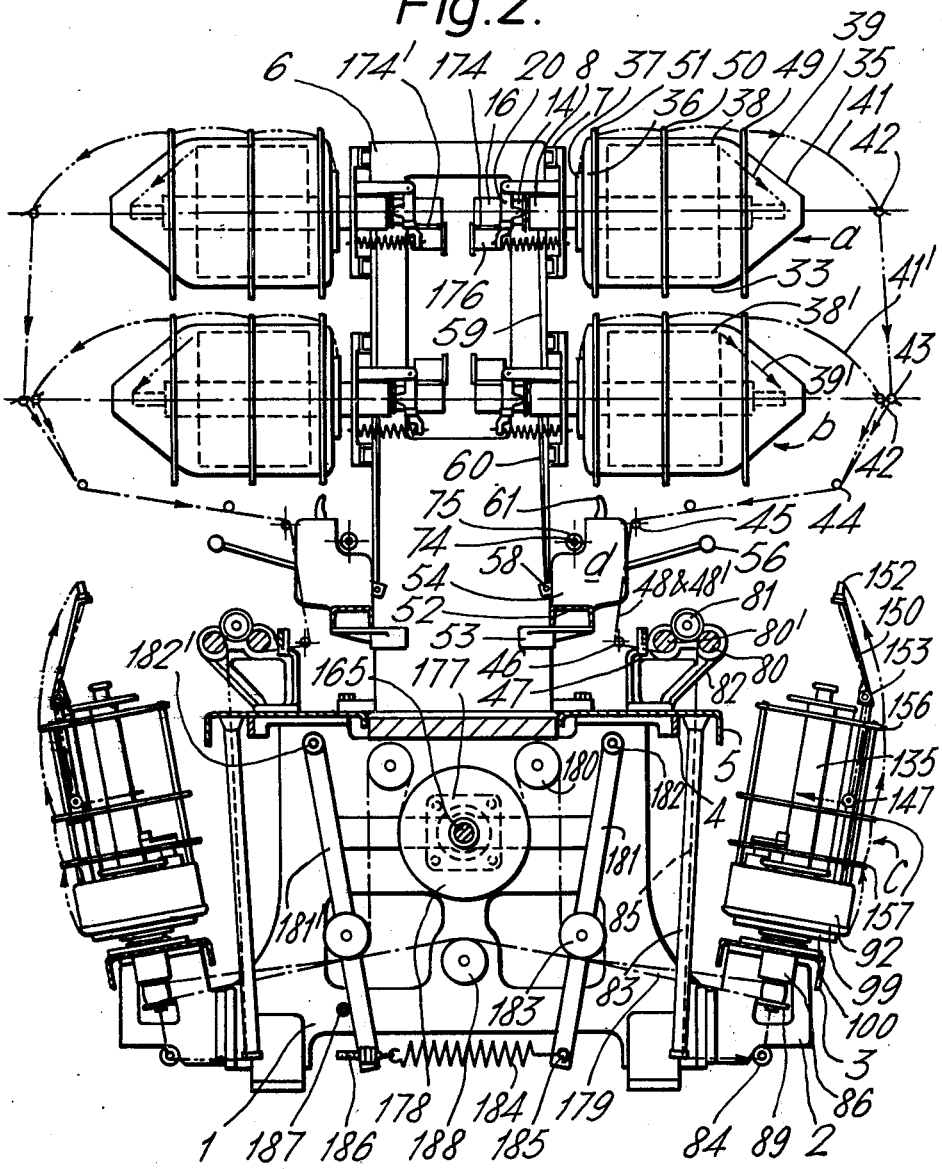
FIG. 2 is a diagrammatic, over-all view, in side elevation of the direct double twist cabler shown in FIG. 1, in which two units of the cabler are symmetrically shown.
Figure 3:
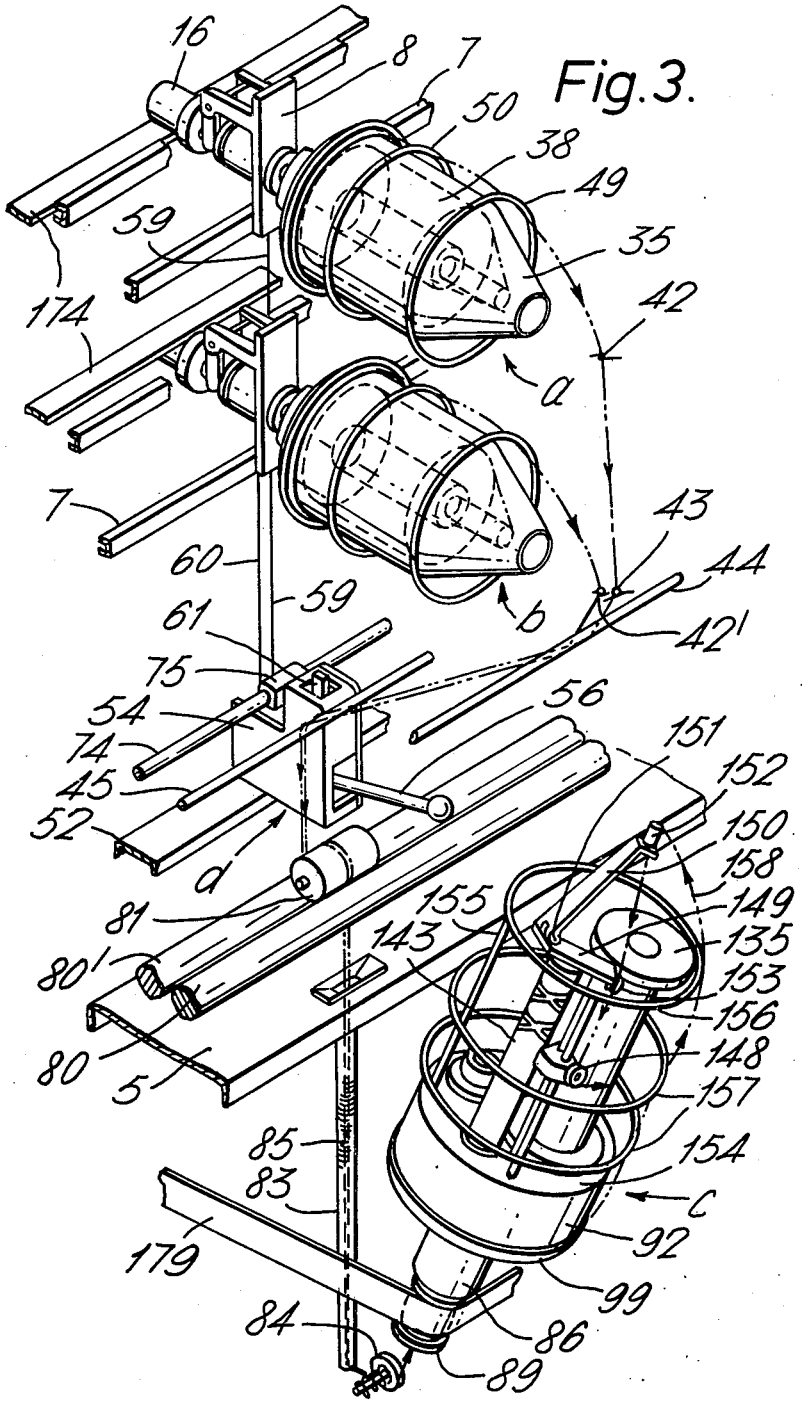
FIG. 3 is a diagrammatic perspective view of the unit shown in FIG. 2, in which a yarn breakage detector and feed rollers are also shown.
Figure 8:
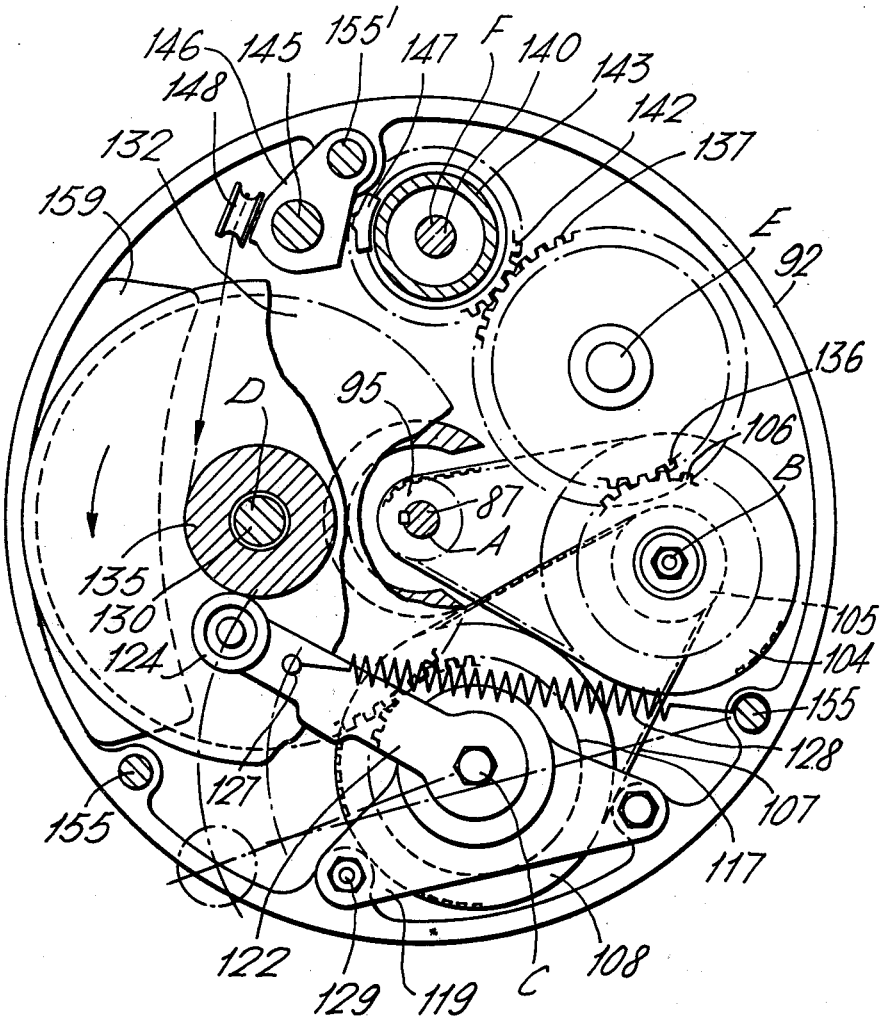
FIG. 8 is a horizontal cross-section through the cabling two-for-one spindle in FIG. 7, taken along the line VII — VII thereof.
Figure 10:
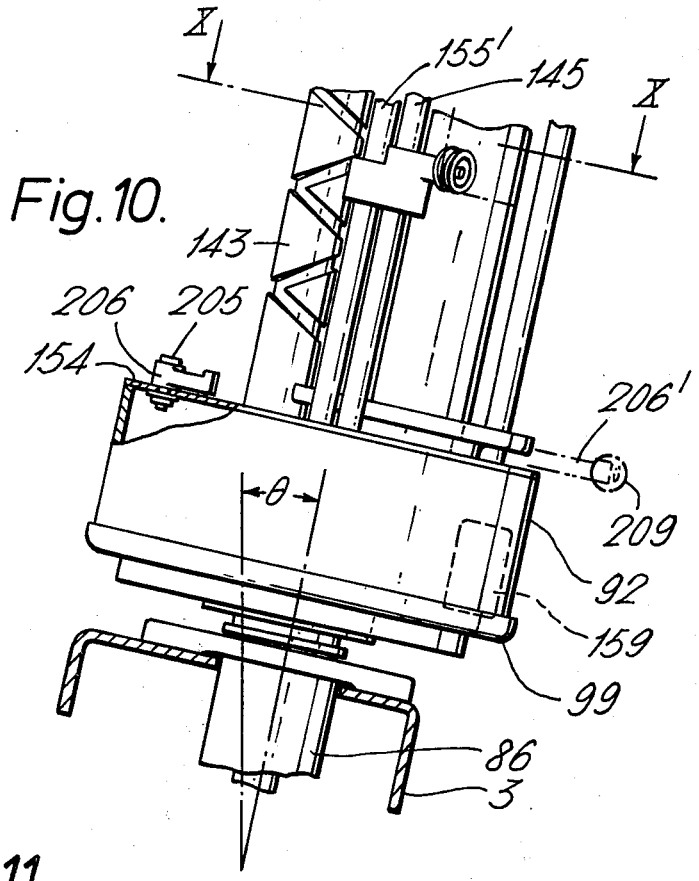
FIG. 10 is a partial front view, partly broken, of a stationary pot of the cabling two-for-one spindle.
Figure 11:
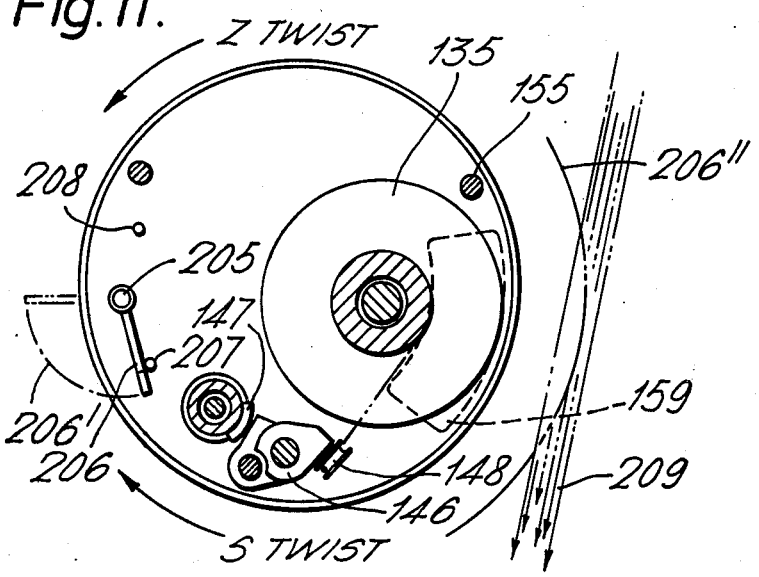
FIG. 11 is a horizontal cross-section through the stationary pot in FIG. 10, taken along the line X — X thereof.

As shown in FIGS. 1, 2 and 3, two plying two-for-one spindles (hereinafter referred to as a spindle) (*a*) and (*b*) are horizontally mounted in parallel on a mounting frame 6 by means of ball bearings 10 in housings 8, which are fixed on rails 7 fixed at the side of the mounting frame. Under the plying spindles a cabling spindle (*c*) is arranged slightly diagonally, such that the axis of rotation thereof is declined at 5° to 15° in relation to the central line of the supporting frame 6. Reference numeral 92 indicates a stationary pot for rotatably supporting the cabling spindle, the stationary pot having a weight 159 eccentrically provided therein, as shown in FIGS. 8, 10 and 11, so as to enable same to posture constantly in the same manner.

Figure 4:
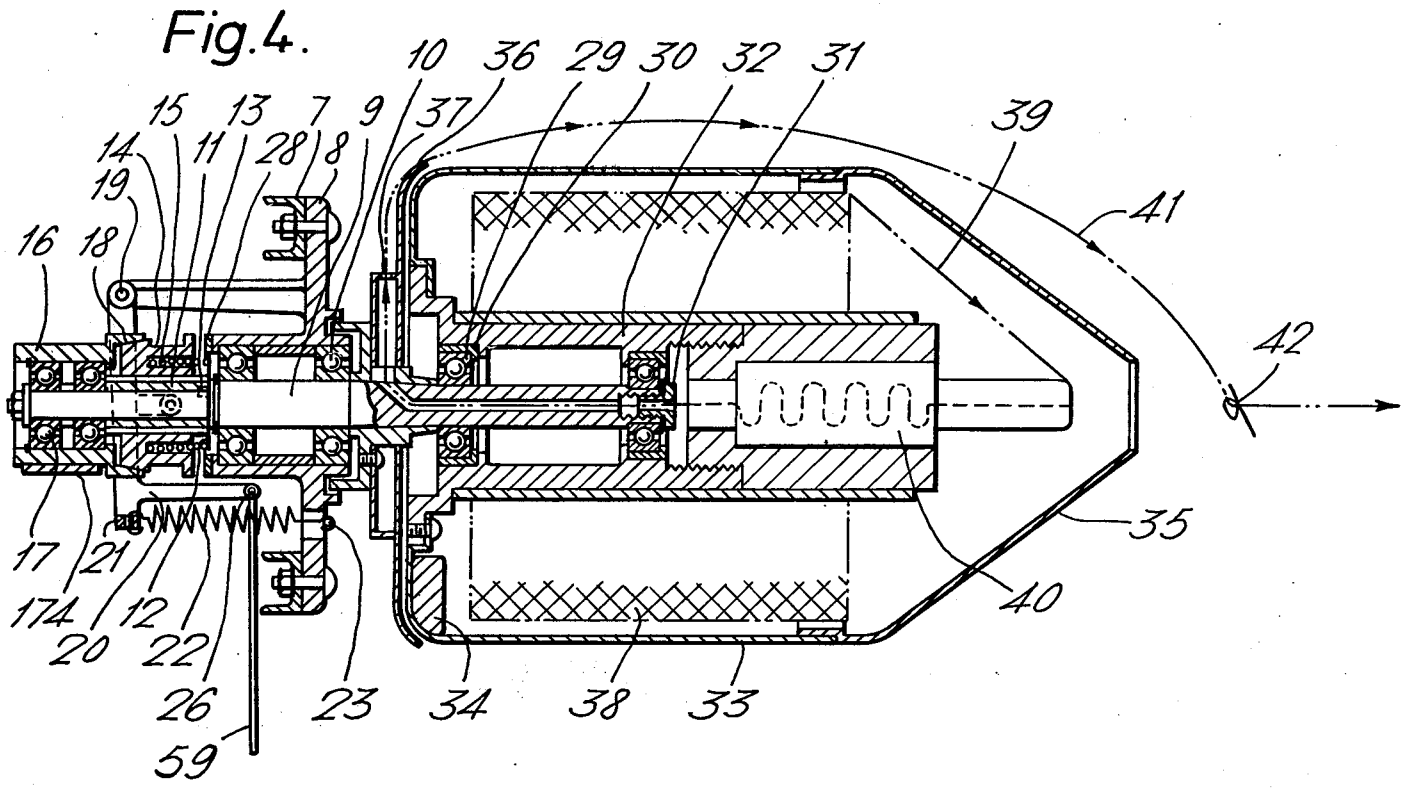
FIG. 4 is a vertical cross-section through a plying two-for-one spindle in use for the direct double twist cabler embodying the present invention.

As best illustrated in FIG. 4, a pulley 16 is rotatably supported on a hollow shaft 9 through ball bearings 17, and a spline bush 11 engageable with a cone clutch 14 is fixed to the hollow shaft 9 by means of a knock pin 13. Reference numeral 12 indicates a spring support, and the spring support, the spline bush 11 and the ball bearings are tightened to the hollow shaft by means of a nut at the top end of the shaft 9.

A disc 36 is rigidly fixed on the hollow shaft 9 so as to ensure their unitary rotation, and a package case 33 is provided with a supply package 38 on the holder 32 thereof, which is free from the rotation of the shaft 9 through ball bearings 29 and a padding member 30 (preferably of electrical conductivity). The package case 33 is provided with a weight 34 eccentrically attached in the bottom thereof, thereby ensuring the stationary state of the package case.

The supply package 38 is inserted in the case 33, and a tension device 40 is fitted in the holder 32, which device is intended to impart to the yarn the initial tension. The case 33 is covered by a cap 35 having a converged top so as to prevent the yarn 39 from being caught by a ballooning yarn 41 under electrostatic force.

Figure 6:
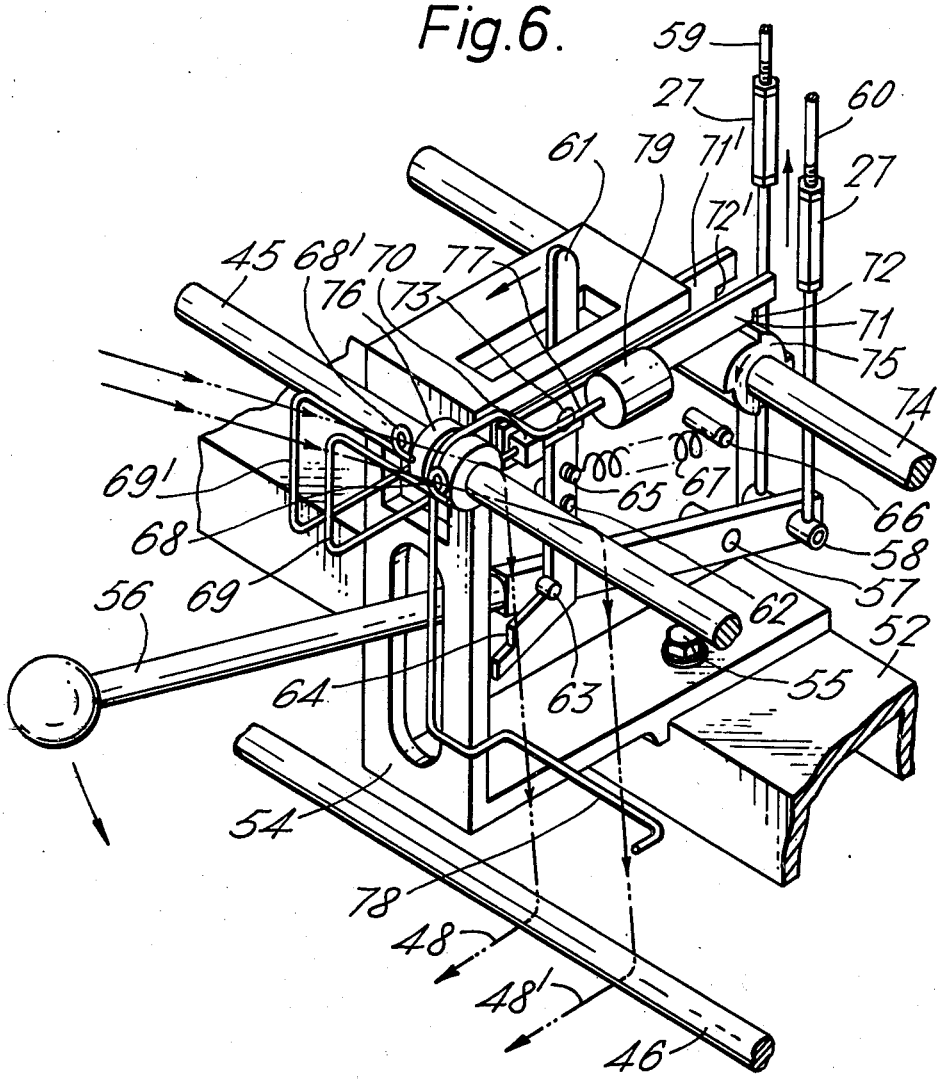
FIG. 6 is a perspective view of an end breakage stop motion to be interposed between the plying unit and the cabling unit.

Referring to FIGS. 3 and 6 a stop motion device (*d*) will be explained, which is intended to detect a possible end breakage of a yarn and stop the twisting operation.

The stop motion (*d*) is provided in each unit consisting of two plying spindles and one cabling spindle, being fixed on a rail 52 by means of a bolt 55 and provided with a handle bar 56, which is pivotally supported on a framework 54 by means of a pin 57. In addition, a lever 61 is uprightly provided in the framework 54 so as to function as a trigger for the handle-bar 56, wherein the lever is pivotally supported on the framework 54 by means of a pivot 62. The lever has a bent corner in its end at which a pin 63 on the handle bar 56 can rest. The bent portion of the lever 61 has a broken part 64, which receives the pin 63 when the lever 61 is pulled in the direction indicated by the arrow in FIG. 6. The lever 61 is provided with a spring 67 so as to enable the pin 63 to rest at the bent corner thereof.

The handle-bar 56 has a pair of connecting rods 59 and 60 fixed by means of a pin 58 so as to secure a unitary motion therebetween when the handle-bar is swung in the direction indicated by the arrow in FIG. 6. The connecting rods 59 and 60 are respectively connected to the plying spindle (*a*) and (*b*) as best illustrated in FIG. 3, in which the rods are associated with shifters 20, respectively (FIG. 5) through a pivot 26.

When the handle-bar 56 is raised upwardly the two rods 59 and 60 are lowered against a spring 22 fixed in the shifter 20, thereby enabling the pin 63 to rest in the bent corner of the lever 61. Thus a roller 25 fixed to the shifter 20 is made free from the outer groove of the cone clutch 14, and is engaged with the depression 18 at the back of the pulley 16, thereby transmitting the driving power to the hollow shaft 9. (FIGS. 4, 5 and 6)

For stopping the plying operation by hand, the lever 61 is pulled in the direction indicated by the arrow in FIG. 6, thereby enabling the pin 63 to be freed from the bent corner of the lever and come into engagement with the broken part 64. This allows the handle-bar 56 to lower, thereby enabling the connecting rods 59 and 60 to rise under the urge of the spring 22, and therefore enabling the end portion of the clutch 14 to come into close contact with a brake shoe 28 fixed to the bearing housing 8 so as to stop the rotation of the disc 36 including the hollow shaft 9. Thus the pulley 16 alone is kept in rotation by means of a belt 174.

Figure 5:
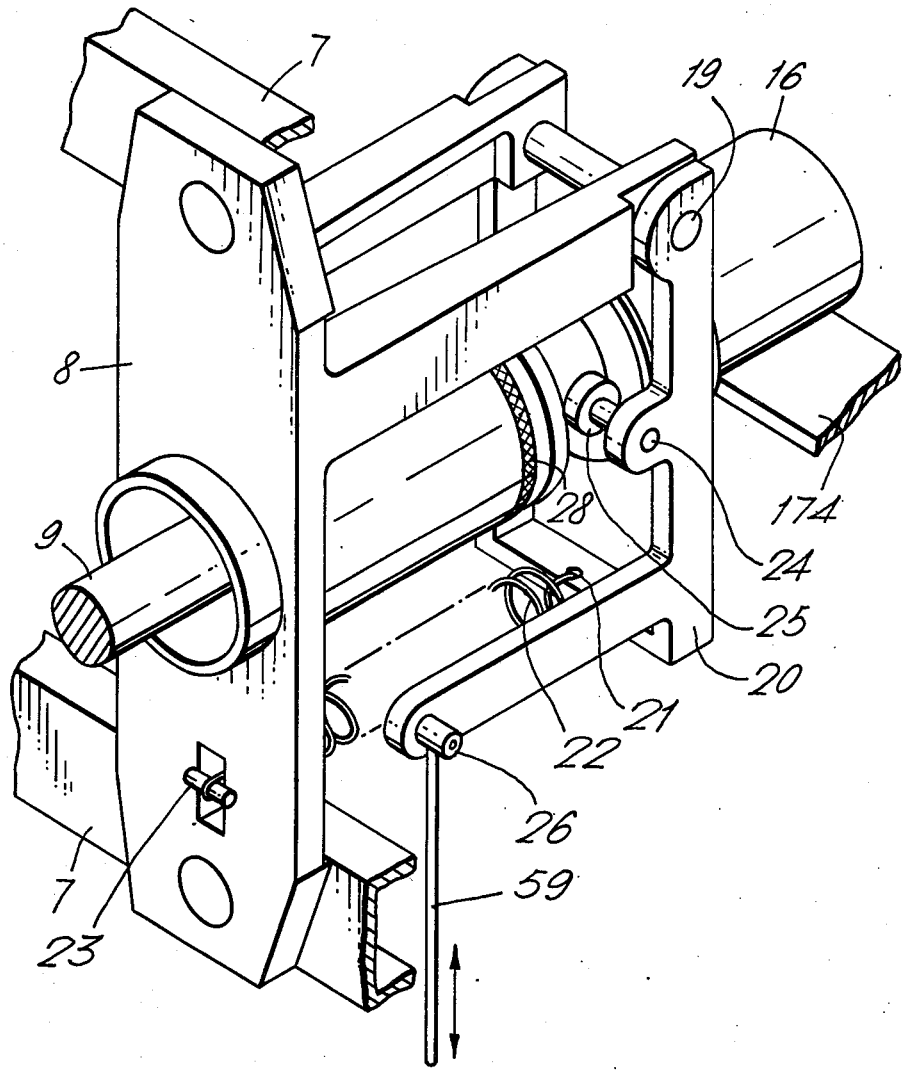
FIG. 5 is a perspective view of the housing and the clutch of the plying two-for-one spindle.

Referring to FIGS. 4, 5 and 6, the stop motion device (*d*) will be further described, in which a typical operation thereof will be referred to:

The yarn 39 drawn from the package 38 in the plying section is led to enter the hollow shaft 9 via a tension device 40, and forms the balloon 41 while passing from the eye 37 of the disc to a snail wire guide 42. Then the yarn passes guide rods 44 and 45, adjacently to which there are provided further yarn guides 69 and 69' with second wire snails 68 and 68' for individually receiving the yarns. The yarn guides 69 and 69' are connected to swinging plates 71 and 71', which are connected to the lever 61 by means of a pivot 73. Reference numerals 70 and 70' indicate mounting blocks of the yarn guides 69 and 69'. The complete set of the swinging plates 71 and 71' and the yarn guides 69 and 69' can swing around the pivot 73 like a seesaw, and when the set is loaded by the tense yarns it is horizontally supported with the shoulders 72 and 72' in the swinging plate free from the tooth of a constantly rotating toothed picker 75. As a whole the complete set is made heavier at the side of the swinging plates 71 and 71' than at the yarn guides 69 and 69', and accordingly, if the load is eliminated with a possible breakage of the yarn the swinging plates 71 or 71' are caused to lower until the shoulders 72 or 72' thereof come into engagement with the tooth of the picker 75. Thus the lever 61 is rotated in the anti-clockwise direction in FIG. 6 around the pivot 62, thereby enabling the pin 63 to dislocate from the bent corner up to the broken part 64. When the pin 63 is lowered the handle-bar 56 follows it, thereby enabling the connecting rods 59 and 60 to rise with the help of the spring 22. When the rods 59 and 60 are raised the shifter 20 is rotated around the pivot 19, thereby causing the cone clutch 14 to become free from the depression 18 of the pulley 16 and the end face thereof to come into abuttment with the brake shoe 28. Thus the rotation of the hollow shaft and the disc is stopped. It is preferred that the push spring 15 in the cone clutch 14 should have a sufficient strength to transmit the power through the engagement of the cone portion with the pulley, and on the other hand, the pull spring 22 on the part of the shifter 20 is desired to have a sufficient strength to overcome the action of the spring 15 so as to disengage the cone from the pulley and push the cone clutch 14 towards the brake shoe 28. The width of the groove in the cone clutch 14 for receiving the roller 25 is desired to be slightly larger than the outside diameter of the roller, such that when the roller is engaged in the groove both sides of the roller are safe from the side walls of the groove. This adjustment can be made by means of turnbuckles 27 in the connecting rods.

In this way the stop motion device (*d*) can stop the plying operation manually by pulling the lever 61 by hand, and also can automatically stop it when one of the yarns is broken during the operation of the machine, under the action of the snail (feeler) 68 or 68', in which the two plying spindles will be simultaneously stopped. In initiating the operation the two plying spindles are started at the same time by operating the handle-bar 56.

Referring to FIGS. 1, 2 and 3, the cabling assembly will be explained:

A mounting frame 1 supports a pair of spindle rail supporters 2 extended outwardly (FIG. 2), in which the rails are respectively mounted in such a manner as to be outwardly declined. Preferably, the angle of decline is 5° to 15° with respect to the vertical axis of the frame 1. Reference numeral 86 indicates a ball bearing housing.

Figure 7:
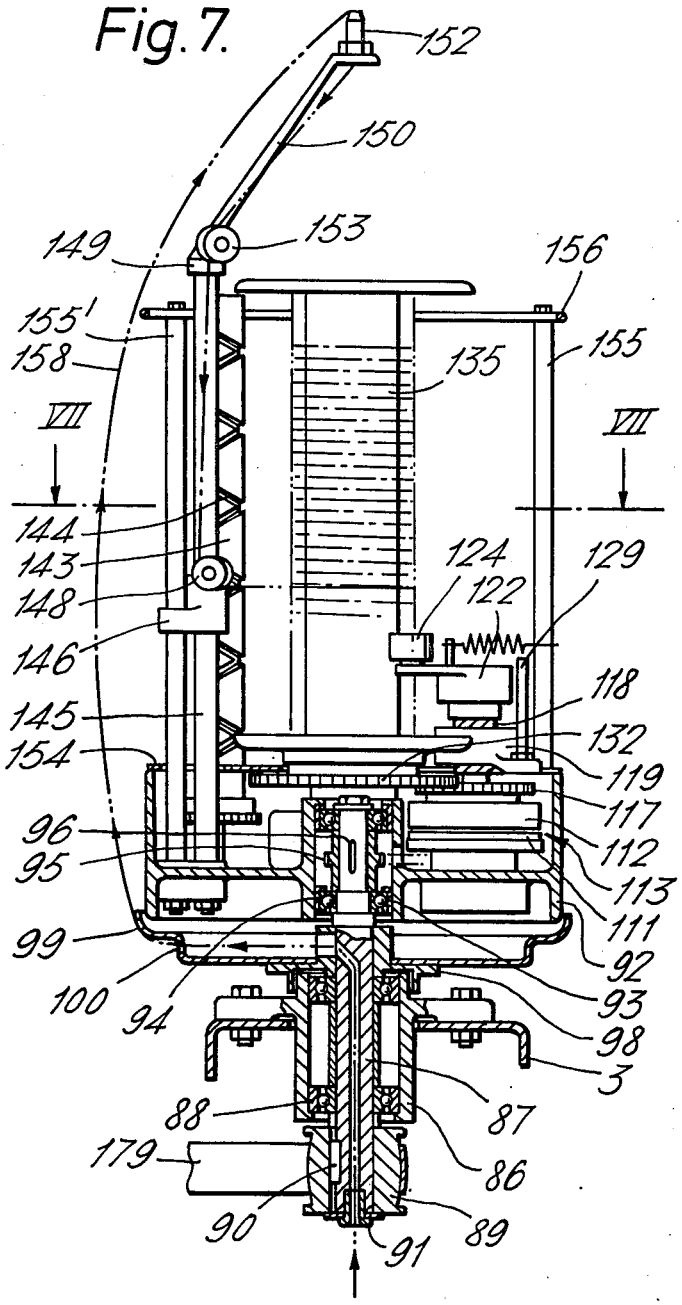
FIG. 7 is a vertical cross-section through a cabling two-for-one spindle in use for the direct double twist cabler embodying the present invention.

As best illustrated in FIG. 7, a hollow shaft 87 is rotatably supported in the bearing housing 86 through ball bearings 88, and a pulley 89 is fixed to the shaft 87 by means of a key 90 and a holed bolt 91. A disc 99 is fixed to a disc holder 98 rigid with the hollow shaft 87.

The stationary pot 92 carries the bobbin 135 and its driving device and a traverse unit thereon while maintaining motionless independently of the rotation of the hollow shaft 87 and the disc 99, wherein the pot is supported on the hollow shaft 87 through a rubber padding piece 94 and ball bearings 93. The pot 92 is provided with the weight 159, as described above, so as to enable same to posture constantly in the same manner. Inside the pot there is provided a driving pulley 95, which is fixed to the shaft 87 by a key 96 in place between the pair of bearings 93 so as to ensure a unitary motion.

Figure 9:
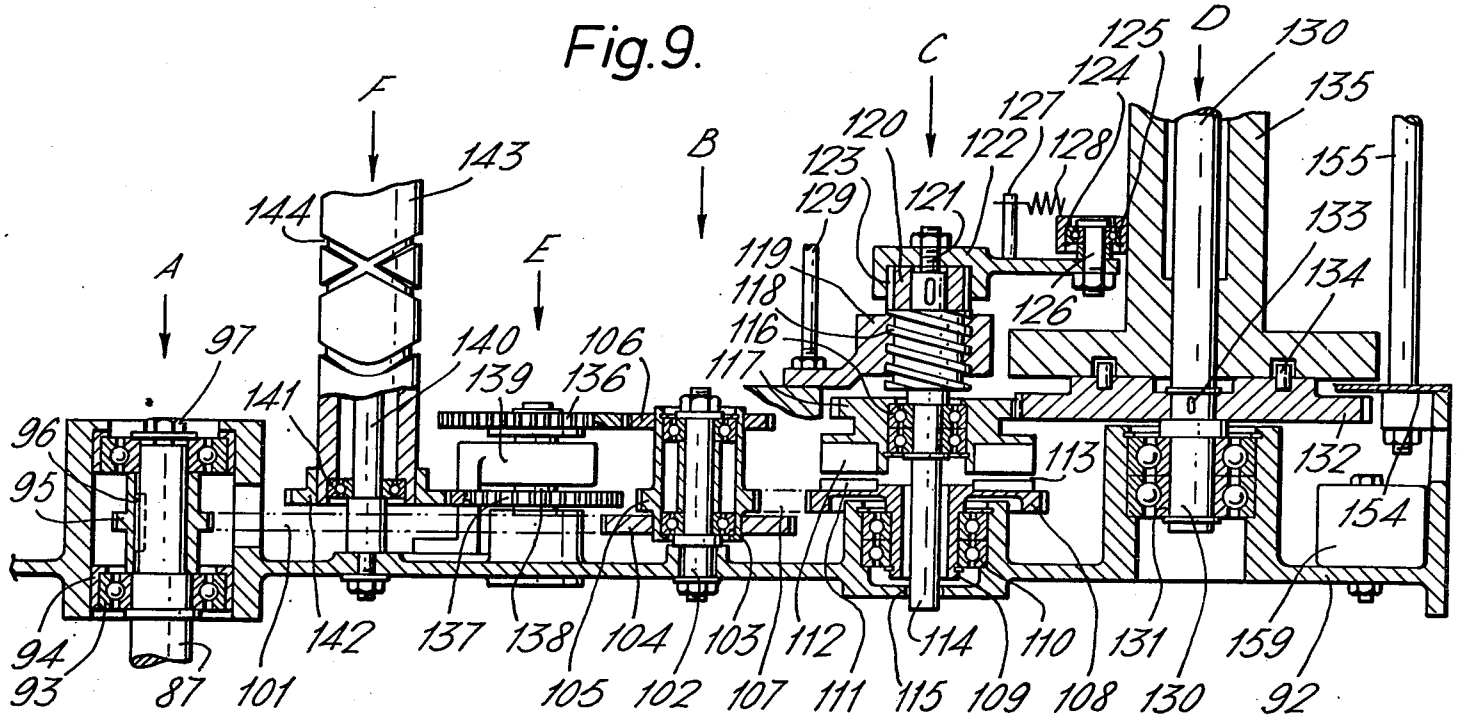
FIG. 9 is a developed view of the cabling two-for-one spindle shown in FIG. 8, wherein each shaft is indicated by reference letters A, B, C, D, E, and F.

In FIG. 9 a shaft 102 is fixed to the pot 92 by means of a nut, and pulleys 104 and 105 and a gear 106, which are associated with each other, are rotatably supported on the shaft 102 through ball bearings 103. The power from the driving pulley 95 is transmitted to the pulley 104 through a belt 101, and then to a pulley 108 on a further shaft 114 through a belt 107 via the pulley 105, the pulley 108 being supported on the pot 92 through boss 109 and ball bearings 110.

The pulley 108 is provided with a steel plate 111 so as to mate with a permanent magnet 112 fixed on the undersurface of a gear 117, which is fixed to a threaded shaft 114 generally indicated by (C) in FIG. 9. The threads 118 of the shaft 114 are received in a supporter 119 mounted on the pot 92, and the top portion of the threads 118 engages with a spline bush 120 fixed to the shaft 114 by means of a key 121. On the spline bush a feeler arm 122 is mounted, wherein the splines 123 are made so as to have a small pitch. A feeler roller 124 can lightly rotate around a pin 126 with the help of ball bearings 125.

In FIGS. 8 and 9 a pull spring 128 on the feeler arm 122 is extended from a pin 127 fixed to the arm up to a pole 155, thereby enabling the roller 124 to come in constant contact with the winding yarns on the bobbin 135 under the action of the spring 128. Under this arrangement the arm 122 is gradually displaced outwardly as the diameter of the bobbin increases with winding yarns.

The distance covered by the arm is equal to the difference between the empty diameter and the full diameter of the bobbin 135. When the arm 122 is being gradually shifted in semi-circle, which causes the threaded shaft 114 to rotate through the spline bush 120, wherein the inside thread of the supporter 119 is made such that when the arm is outwardly shifted the shaft 114 is lowered through an aperture 115, thereby shortening the gap 113 between the magnet 112 and the steel plate 111. Thus as the gap 113 is becoming small in accordance with the increase in the outside diameter of the bobbin, the torque transmitted will be accordingly enlarged.

Referring to FIGS. 7, 8 and 9, a traverser will be explained, which is intended to reciprocate between both flanges of the bobbin at an effectively reduced speed to wind a yarn up the bobbin:

When the hollow shaft 87 is rotated, it is transmitted to the gear 106 through the pulley 95, the belt 101 and the pulley 104, thereby rotating the input gear 136 of a speed reducer device 139, which incorporates a differential means having a ratio of 1 to 150 or more. The power is further transmitted to a gear 142 through the output shaft 138 and a gear 137, the gear 142 being fixed to a cylindrical cam 143 having a ball bearing 141 fitted on a shaft 140 erected on the pot 92, thereby enabling the cylindrical cam 143 to rotate at a desired speed. A slider 146 is freely supported on a pole 145 fixed to the pot 92, wherein a subpole 155' is employed to prevent the slider from rotating around the main pole 145. The slider 146 is provided with a rotatable traverser shoe 147 whose top portion is received in the cam groove 144. At the opposite side of the shoe 147 there is provided a guide roller 148 intended to change the direction of a cord sent through a top guide 152 and a roller 153 towards the bobbin 135. Thus the rotation of the cam 143 causes the traverse shoe 147 to move along the cam groove 144, thereby winding the cord up the bobbin 135 between the flanges thereof in equal density.

A top centre guide arm 150 is hinged to an arm base 149 by a hinge pin 151, the arm base being mounted on the shaft 140 and the guide shaft 145, thereby enabling the top centre guide arm to rotate by hand when the bobbin is taken out or mounted.

On the poles 155 and 155' there is provided a covering ring-shaped plate 156, so as to prevent the balloon 158 from being caught inside the spindles, in which the circular outline of the plate 156 is helpful in guiding the balloon. As best illustrated in FIG. 2 one or more balloon control rings 157 can be provided.

The pot 92 is covered by a cover 154 as shown in FIG. 10, so as to avoid a possible intrusion of dust and dirt, wherein the pole 155 is locked by the cover.

In FIGS. 10 and 11 the stationary pot 92 is slantly supported as described above, preferably at the angle of 5° to 15°, which is indicated by letter $\theta$. In addition the pot is provided with the weight 159 so as to enable same to maintain the same stationary position with the weight downwards. However there is a liklihood that the pot is caused to rotate against the weight by an unexpected force, which would possibly result in an accident, such as the breakage of the hollow shaft 87. In order to prevent this possible accident there is provided a shut-off arm 206 on a pivot 205 fixed to the cover 154, the location of the pivot being opposed to the weight 159. In normal operation the shut-off arm 206 rests on the stopper 207, but if the pot is caused to rotate, the arm 206 follows it and displaces to a position indicated by reference numeral 206' under the centrifugal action. In the trace of the arm a photoelectric tube unit (not shown) is located so as to catch the running arm electrically by the use of an electric beam 209, through which the electric motor 161 can be deenergized to stop the operation. In FIG. 11 a further stopper 208 is for the Z-twist operation. After the motor has been shut off it may happen that the pot continues to rotate by inertia for some time, and therefore a magnetic brake 210 can be provided on the driving shaft 165 in such a manner as to have an electrical connection with the photo-electric tube unit. A warning bell or light can be additionally employed.

The first-twisted component yarns are led by feed rollers 80 and 80', and a top roller 81 to the hollow shaft 87 in the cabling assembly (*c*), which, unlike the known machines, is located under the plying assemblies (*a*) and (*b*) and even the feed rollers. Also the yarn entrance of the hollow shaft is located in the undermost part thereof, thereby resulting in a long yarn running distance. In order to avoid a possible entanglement of the running yarns and the balloon 158 a yarn protective pipe 83 is provided by passing through the top plate 5. The pipe 83 will also serve a guide when the yarn is introduced in the equipment.

Under the cabling assembly (*c*) there is provided a tenser 84 (FIG. 3) as an intermediate carrier of the first-twisted yarns, located between the yarn protective pipe and the hollow shaft 87. The tenser is effective in preventing a broken yarn from being caught in the rotating disc section.

To effect the automatic operation, the plying spindles, the cabling spindles and the feed rollers must synchronously be rotated througout the process. As illustrated in FIGS. 1 and 2 a single electric motor performs the whole operation in a synchronous manner, which will be described hereinafter.

The power of the motor 161 is transmitted to a driving pulley 164 via a pulley 162 and a belt 163, thereby driving the main shaft 165, which is extended along the central line of the equipment with the intermediate support of the frames 1 through ball bearings 177.

At each side of the main shaft 165 two cabling spindles (in the illustrated embodiment) or more can be provided with a common pulley 178. The cabling spindles are driven by means of an endless belt 179, which is pulled over pulleys 183 and 183' via a guide pulley 180, the pulleys 183 and 183' being carried on respective levers 181 and 181' supported on pivots 182 and 182'.

The levers 181 and 181' are provided with a pin 185 and an adjusting bolt 186, respectively, wherein the pin and the adjusting bolt are connected by a coiled spring 184 so as to impart to the belt 179 a required strength of tension. A stop 187 is provided on the frame 1 to prevent an undesired swing of the lever 181' occurring when the driving of the belt 179 is initiated. When the pulley 178 is reversely rotated to obtain the reversed twist the stop 187 must be located at opposite place so as to prepare against the undesired swing of the lever 181. The belting between the slantly-mounted cabling spindles (*d*) and (*d'*) is helped by the pulley 188, which functions as a mediator to ensure a straight belting between the pulleys 89 and 89'. As described above, no special belting is required, but an ordinary endless belt can be used.

To drive the plying spindles (*a*), (*b*), (*a'*), (*b'*), a driving pulley 166 is provided on the main shaft 165 so as to transmit the drive to a pulley 168 and a gearing section 169 where the drive is divided into two routes consisting of pulleys 170 and 170', belts 171 and 171', pulleys 172 and 172', the last-named pulleys driving pulleys 173 and 173'. Between the pulley 173 and a pulley 175 there is provided a belt 174, which drives the plying spindles (*a*) and (*b*). Likewise a belt 174' drives the plying spindles (*a'*), (*b'*). Preferably the pulleys 175 and 175' can be provided with a suitable tension adjuster (not shown) so as to maintain a required amount of tension. In the illustrated embodiment an adequate number of tension pulleys are provided between the pair of pulleys 173 and 175; 173' and 175', so as to reduce a possible slipping to the minimum.

Referring to FIG. 1 the operation of the feed rollers on which the number of twists depends will be explained:

The feed rollers receive a driving power from the main shaft 165. A roller driving gear 189 fixed to the end of the main shaft transmits the power to a gear 192 via a reduction gear 190 and a shaft 191, which drives its mating gear 193 connected to a gear 195 by a shaft 194. Thus a pair of gears 196 and 196' are driven, through which shafts 197 and 197' are rotated, thereby driving pulleys 200 and 200' via pulleys 198 and 198', blets 199 and 199' and back roller 80. This roller is additionally provided with a gear 201, which engages with an idle gear 202 meshing with a further gear 203. By this gear 203 the front roller 80 is rotated in the same direction as that of the back roller 80'. The feed rollers 80 and 80' are carried on a stand 82 fixed to a top beam 5 mounted on the intermediate frame 1. At the individual groups the top roller 81 is kept in touch with the rollers 80 and 80' so as to ensure the catching of the first-twisted yarns 48 and 48' up to the cabling spindle assembly (*c*). The other side of the equipment is constructed in the same manner, the detailed description of which is omitted.

The number of twists or turns can be controlled by change gears 192, 193 and 195, among which the gears 192 and 193 are changed together because of their fixed axial distance.

Under the arrangement embodying the present invention the yarns are passed, twisted and wound in the following manner:

The yarns 39 and 39' are drawn from the supply packages 38 by means of the feed rollers 80 and 80' and the top roller 81, and are led into the bore of the hollow shaft 9 after an unequal tension has been corrected, if any, and the initial tension has been imparted thereto by means of a suitable tension device.

Since the hollow shaft 9 and the disc 36 are rotated by means of the belt 174 via the pulley 16, the first twist is imparted to the yarns during their passing at right angle to the eye 37 of the disc 36, and the second twist is given when the yarns pass from the eye 37 to the snail guide 42 while forming the balloons 41 and 41'. The two yarns meet at the guide rod 44, and then each yarn is passed through the feeler snail 68 and 68', so as to watch against a possible breakage thereof. Between the guide rods 45 and 46 the yarns are kept in touch with the tension wire 78 where a required amount of tension is imparted thereto, as shown in FIG. 6.

The yarns 85 are led into the yarn protective pipe 83 and are drawn from the lower end opening thereof so as to enter the hollow shaft 87 via the tenser 84. Since the hollow shaft 87 and the disc 99 are rotated constantly at equal speed by means of the belt 179 through the pulley 89, the yarns undergo a twist in the opposite direction to the preceding plying twist when they are led at right angle to the eye 100 of the disc, and the second cable twist is imparted thereto when they pass in between the eye 100 and the top centre guide 152, during which the yarns form the balloon 158. Then the cabled yarns are led as a single cord within the balloon via the top centre guide 152, and wound up the bobbin 135 via the guide roller 153 and a further guide roller 148 carried on the slider 146.

The number of cable twist as well as ply twist will be determined by selecting the r.p.m. of each hollow shaft for plying and calbing with respect to the speed of delivery of yarn by the feed rollers 80, 80' and 81. For the plying process the yarns are led from above the disc, and for the cabling process the yarns are led from above, that is, from the plying assembly mounted in the upper section of the equipment. Therefore, when the direction of turn is clockwise as viewed from above the pot 92, the ply twist will be Z-twist, and the cable twist will be S-twist.

The following are the comparative data obtained from the demonstration of a conventional process (ring & ring type), a conventional combined process (two-for-one & ring type) and the direct double twist cabler embodying the present invention (two-for-one & two-for-one type):

| Type | Conventional process (Ring & ring type) | | Conventional/combined process (Two-for-one & ring type) | | The present invention (Two-for-one & two-for-one type) | |
|---|---|---|---|---|---|---|
| | 1st twist | 2nd twist | 1st twist | 2nd twist | 1st twist | 2nd twist |
| Raw material | Nylon multifilament yarn - 1,260 denier | | | | | |
| Cord construction | 1,260 denier/2 | | | | | |
| Number of twists | 390 (Z-twist) × 390 (S-twist) Turn/meter | | | | | |
| Spindle r.p.m. | 7,000 | 6,500 | 3,100 | 6,200 | 4,250 | 4,250 |
| Machine efficiency | 95% | | | | | |
| Size of ring (Inside diameter m/m) | 140.0 | 140.0 | — | 165.0 | — | — |
| Number of spindles | 156 | 156 | 216 | 108 | 200 | 100 |
| Take-up package (Kg) | ϕ 2.7 | 2.5 | — | 3.6 | — | 4.2 |
| Required frame | 19 | 11 | 15 | | 12 | |
| | Total 30 | | | | | |
| Space required for machine installation ($m^2$) | 760 | 440 | 780 | | 725.4 | |
| | Total 1,200 | | | | | |
| Power consumption (KWH/ton product) | 1,120 | 672 | 1,100 | | 1,060 | |
| | Total 1,792 | | | | | |
| Noise (db) | 98 | 92 | 95 | | 86 | |

What is claimed is:

1. A direct double twist cabler comprising a mounting frame having at least two two-for-one spindles for plying and one two-for-one spindle for cabling for each two plying spindles, said plying spindles having their axes substantially horizontally disposed in the upper section of the equipment, said cabling spindle having its axis outwardly slanting in the range of 5° to 15° from the vertical, the lowest part of said cabling spindle being lower than the lowest part of said plying spindles, a tension adjusting means, a yarn breakage detecting means, means for braking said plying spindles upon detection of a yarn break, and adjustable magnetic means for winding up cable in said cabling spindle.

2. A direct double twist cabler as claimed in claim 1, wherein the plying spindles and the cabling spindles are composed of groups, each group consisting of two plying spindles and a single cabling spindle, said groups being installed in equal number at opposite sides of the equipment.

3. A direct double twist cabler as claimed in claim 1, wherein the braking means in said plying spindles comprise at least one cone-shaped clutch engageable with the driving pulley thereof, said at least one cone-shaped clutch being operable in response to the breakage of yarn so as to set free said spindles from said driving pulleys.

4. A direct double twist cabler as claimed in claim 3, wherein a brake shoe is additionally provided so as to contact the brake on the clutch when the clutch is disengaged from the driving pulley.

5. A direct double twist cabler as claimed in claim 1, wherein the yarn breakage detecting-and-stopping means comprises yarn guide in the corresponding number to the number of said yarn, each yarn being passed through said yarn guide individually so as to detect each possible breakage of yarn, trigger means operative to actuate said braking means, and said yarn guides preventing said trigger from actuating said braking means when yarn is passing therethrough.

6. A direct double twist cabler as claimed in claim 1, wherein between the cabling two-for-one spindle and the feed rollers a yarn protective pipe is provided for the passage of yarn, so as to guarantee the passing thereof over a relatively long distance therebetween.

7. A direct double twist cabler as claimed in claim 1, wherein a tenser is provided adjacently to the entrance of the cabling two-for-one spindle, said tenser being provided with a nipping means preventing a possible broken yarn from being caught in the rotating disc section of the cabling spindle.

8. A direct double twist cabler as claimed in claim 1, wherein the take-up bobbin in the cabling assembly is provided with a weight eccentrically mounted so as to enable said take-up bobbin to posture in the declining direction of said cabling assembly.

9. A direct double twist cabler as claimed in claim 1, wherein said adjustable magnetic means comprises a torque adjuster for controlling the rotation of the bobbin in accordance with the increasing diameter thereof, said torque adjuster including a permanent magnet and a mating magnetizable piece, and a feeler means keeping contact with the periphery of said bobbin.

10. A direct double twist cabler as claimed in claim 9, wherein the feeler means includes a spring urging said feeler means to keep contact with the periphery of said bobbin, and wherein the feeler arm has a splining relationship with a shaft carrying either said permanent magnet or said magnetizable piece, so as to permit said shaft to have lengthwise minute movement with respect to the counterpart to said permanent magnet or magnetizable piece.

* * * * *